US009951292B2

(12) United States Patent
Genet et al.

(10) Patent No.: US 9,951,292 B2
(45) **Date of Patent: *Apr. 24, 2018**

(54) GREASE COMPOSITION

(71) Applicant: TOTAL MARKETING SERVICES, Puteaux (FR)

(72) Inventors: Nicole Genet, Villeurbanne (FR); Xavier Barc, Vilette de Vienne (FR)

(73) Assignee: Total Marketing Services, Puteaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/365,414

(22) PCT Filed: Dec. 14, 2012

(86) PCT No.: PCT/EP2012/075654

§ 371 (c)(1),
(2) Date: Jun. 13, 2014

(87) PCT Pub. No.: WO2013/087896

PCT Pub. Date: Jun. 20, 2013

(65) Prior Publication Data

US 2015/0005209 A1 Jan. 1, 2015

(30) Foreign Application Priority Data

Dec. 16, 2011 (FR) ..... 11 61861

(51) Int. Cl.

| | |
|---|---|
| ***C10M 169/04*** | (2006.01) |
| ***C10M 169/06*** | (2006.01) |
| ***C10M 169/02*** | (2006.01) |
| *C10M 105/38* | (2006.01) |
| *C10M 117/04* | (2006.01) |
| *C10M 135/06* | (2006.01) |
| *C10M 135/36* | (2006.01) |

(52) U.S. Cl.

CPC ..... *C10M 169/06* (2013.01); *C10M 169/02* (2013.01); *C10M 169/04* (2013.01); *C10M 105/38* (2013.01); *C10M 117/04* (2013.01); *C10M 135/06* (2013.01); *C10M 135/36* (2013.01); *C10M 2205/12* (2013.01); *C10M 2207/026* (2013.01); *C10M 2207/1256* (2013.01); *C10M 2207/1265* (2013.01); *C10M 2207/1285* (2013.01); *C10M 2207/289* (2013.01); *C10M 2207/2835* (2013.01); *C10M 2215/223* (2013.01); *C10M 2219/024* (2013.01); *C10M 2219/106* (2013.01); *C10N 2210/01* (2013.01); *C10N 2210/02* (2013.01); *C10N 2220/022* (2013.01); *C10N 2230/06* (2013.01); *C10N 2230/12* (2013.01); *C10N 2230/64* (2013.01); *C10N 2240/08* (2013.01); *C10N 2240/10* (2013.01); *C10N 2250/10* (2013.01)

(58) Field of Classification Search

CPC ..... C10M 105/38; C10M 117/04; C10M 129/70; C10M 129/95; C10M 133/28; C10M 135/06; C10M 169/00; C10M 2207/106; C10M 2207/28; C10M 2207/2835; C10M 2207/40; C10M 2215/182; C10M 2219/024; C10M 2290/00; C10N 2250/00

See application file for complete search history.

(56) References Cited

U.S. PATENT DOCUMENTS

| | | | | |
|---|---|---|---|---|
| 5,595,965 | A | 1/1997 | Wiggins | |
| 6,316,392 | B1 | 11/2001 | Heimann et al. | |
| 8,624,071 | B2 | 1/2014 | Vermeiren et al. | |
| 8,648,224 | B2 | 2/2014 | Vermeiren et al. | |
| 2003/0139302 | A1* | 7/2003 | Akada | C10M 169/06 508/462 |
| 2006/0025314 | A1 | 2/2006 | Henly | |
| 2007/0184990 | A1 | 8/2007 | Norman et al. | |
| 2011/0306527 | A1 | 12/2011 | Bouffet et al. | |
| 2012/0142983 | A1 | 6/2012 | Vermeiren et al. | |
| 2012/0157728 | A1 | 6/2012 | Vermeiren et al. | |
| 2013/0267447 | A1 | 10/2013 | Bardin | |
| 2013/0281331 | A1 | 10/2013 | Bardin | |
| 2014/0114105 | A1 | 4/2014 | Vermeiren et al. | |
| 2014/0155665 | A1 | 6/2014 | Vermeiren et al. | |

FOREIGN PATENT DOCUMENTS

JP 2008208240 A * 9/2008

OTHER PUBLICATIONS

Chinese Office Action dated Mar. 11, 2016 (English Translation).

* cited by examiner

*Primary Examiner* — Taiwo Oladapo
(74) *Attorney, Agent, or Firm* — Harness, Dickey & Pierce, PLC

(57) ABSTRACT

The disclosure includes a grease composition comprising providing at least one polyol-ester base oil, at least one fatty-acid metal soap, at least one dimercaptothiadiazole derivative, and at least one sulfurous fatty-acid ester, the amount of active sulfur provided by the sulfurous fatty-acid ester at 150° C. according to the ASTM D1662 standard being greater than or equal to 0.18 wt % with respect to the total weight of the grease composition.

8 Claims, No Drawings

GREASE COMPOSITION

CROSS-REFERENCE TO RELATED APPLICATIONS

This application is a National Phase Entry of International Application No. PCT/EP2012/075654, filed on Dec. 14, 2012, which claims priority to French Patent Application Serial No. 1161861, filed on Dec. 16, 2011, both of which are incorporated by reference herein.

FIELD OF THE INVENTION

The present invention relates to grease compositions, in particular grease compositions having a reduced environmental impact and exhibiting good extreme pressure and corrosion properties, in particular with respect to metals or metal alloys.

BACKGROUND

Recent times have seen the increasing significance of environmental problems on a worldwide scale and the enforcement of protection of the terrestrial biosphere as a major challenge in all sectors of industry. The field of greases is no exception to the rule, and the risk of pollution of watercourses and soils that is represented in particular by disposal into the natural environment of base oils, the main ingredients of these products, means that today progress is expected in respect of these oils, in particular in the area of biodegradability, for uses which involve the risk of external leakage of greases. At the same time, increasingly powerful machinery is subject to demands under ever more severe conditions and in addition to biodegradability, for example, their lubrication products are required to show significant improvements in performance in terms of extreme pressure and corrosion properties.

The present invention relates to a grease composition that can be used in devices which present a risk of external leakage of grease such as automobiles, construction machinery or agricultural equipment, while at the same time having a reduced environmental impact, good performance under extreme pressure and a low corrosiveness to metals or metal alloys. Surprisingly, the applicant observed that a grease composition having a combination of at least one sulfurized fatty acid ester, said ester providing a certain quantity of active sulphur at 150° C. according to standard ASTM D1662, and at least one dimercaptothiadiazole derivative, in a base oil of the polyol ester type, has very good extreme pressure properties, is not corrosive in particular to metals or metal alloys, in particular to copper, while having a reduced environmental impact.

SUMMARY

The invention relates to a grease composition comprising at least one base oil of the polyol ester type, at least one fatty-acid metal soap, at least one dimercaptothiadiazole derivative and at least one sulfurized fatty acid ester, the quantity of active sulphur at 150° C. according to standard ASTM D1662 by mass provided by the sulfurized fatty acid ester with respect to the total mass of grease composition being greater than or equal to 0.18%. Preferably, the polyol ester is chosen from neopentylglycol esters, trimethylolethane esters, trimethylolpropane esters, pentaerythritol esters and/or dipentaerythritol esters, used alone or in a mixture. Preferably, the composition comprises from 50 to 95% by mass with respect to the total mass of grease composition of a base oil of the polyol ester type, preferably from 60 to 90%, more preferentially from 70 to 80%.

Preferably, the dimercaptothiadiazole derivative is chosen from the derivatives of 4,5-dimercapto-1,2,3-thiadiazoles, 3,5-dimercapto-1,2,4-thiadiazoles, 3,4-dimercapto-1,2,5-thiadiazoles, 2,5-dimercapto-1,3,4-thiadiazoles, used alone or in a mixture. Preferably, the composition comprises from 0.1 to 5% by mass of dimercaptothiadiazole derivative with respect to the total mass of grease composition, preferably from 0.2 to 2%, more preferentially from 0.5 to 1%.

Preferably, the sulfurized fatty acid ester is a fatty acid triglyceride and/or a fatty acid methyl ester, used alone or in a mixture. Preferably, the composition comprises from 0.5 to 5% by mass of sulfurized fatty acid ester with respect to the total mass of grease composition, preferably from 1 to 4%, more preferentially from 2 to 3%.

Preferably, the fatty-acid metal soap is a simple fatty-acid metal soap, preferably of lithium or calcium. Preferably, the fatty-acid metal soap is lithium 12-hydroxystearate. Preferably, the composition comprises from 1 to 20% by mass with respect to the total mass of the grease composition of fatty-acid metal soap, preferably from 2 to 15%, preferentially from 4 to 12%.

Preferably, the polyol ester, or the mixture of polyol esters, has a kinematic viscosity at 40° C., measured according to standard ASTM D 445, comprised between 3 and 2000 cSt, preferably between 10 and 1500 cSt, more preferentially between 40 and 500 cSt, even more preferentially between 50 and 200 cSt. Preferably, the composition has a consistency according to standard ASTM D217 comprised between 220 and 430 tenths of a millimeter, preferably between 265 and 295 tenths of a millimeter. Preferably, the quantity of active sulphur at 150° C. according to standard ASTM D1662 by mass provided by the sulfurized fatty acid ester, with respect to the total mass of grease composition, is preferably greater than or equal to 0.19%, preferably greater than or equal to 0.20%, more preferentially greater than or equal to 0.21%.

Preferably, the composition has a welding load according to standard ASTM D2596 greater than 315 kg, preferably greater than or equal to 400 kg. Preferably, the composition has a welding load according to standard DIN 51350/4 greater than 300 daN, preferably greater than or equal to 320 daN, more preferentially greater than or equal to 340 daN, even more preferentially greater than or equal to 360 daN. Preferably, the composition has a classification of corrosiveness to copper according to standard ASTM D4048 of 1 or 2.

The invention also relates to the use in a grease composition comprising at least one base oil of the polyol ester type and at least one fatty-acid metal soap of at least one dimercaptothiadiazole derivative and at least one sulfurized fatty acid ester, the quantity by mass of active sulphur at 150° C. according to standard ASTM D1662 provided by the sulfurized fatty acid ester being greater than or equal to 0.18%, with respect to the total mass of grease composition, in order to improve the extreme-pressure performance according to standards ASTM D2596 and/or DIN 51350/4 of the grease composition. The invention also relates to a lubricant composition comprising at least one base oil of the polyol ester type, at least one dimercaptothiadiazole derivative and at least one sulfurized fatty acid ester, the quantity by mass of active sulphur at 150° C. according to standard ASTM D1662 provided by the sulfurized fatty acid ester with respect to the total mass of lubricant composition being greater than or equal to 0.18%.

DETAILED DESCRIPTION

Sulfurized Fatty Acid Ester

The grease according to the invention comprises at least one sulfurized fatty acid ester. The sulfurized fatty acid esters are obtained by sulphurizing fatty acid esters. Said fatty acid esters are obtained by reaction between one or more fatty acids and alcohols of all sorts or by transesterification between one or more fatty acid esters and alcohols of all sorts. By sulfurized fatty acid ester is meant an ester of at least one sulfurized fatty acid, it being understood that this is usually an ester of a mixture of sulfurized fatty acids.

The fatty acids that can be used to form the sulfurized fatty acid esters are all fatty acids comprising from 6 to 24 carbon atoms, preferably from 14 to 22 carbon atoms, more preferentially from 16 to 20 carbon atoms. Fatty acids comprising 18 carbon atoms are the majority fatty acids, i.e. they are present at a concentration by mass of at least 50% with respect to the total mass of sulfurized fatty acid ester.

The sulfurized fatty acid esters may be sulfurized fatty acid monoesters, sulfurized fatty acid diesters, sulfurized fatty acid triesters or sulfurized fatty acid polyesters, used alone or in a mixture. Preferred sulfurized fatty acid monoesters are $C_1$-$C_4$ alkyl monoesters, such as methyl monoesters, ethyl monoesters, n-propyl monoesters, i-propyl monoesters, n-butyl monoesters, s-butyl monoesters, t-butyl monoesters. Preferably, the monoester is a methyl monoester. Preferably the sulfurized fatty acid ester is a sulfurized fatty acid methyl ester.

As an example of sulfurized fatty acid triesters there may be mentioned sulfurized fatty acid triglycerides which will be fully or partially esterified and will therefore, in addition to the triesters, optionally comprised diesters and/or monoesters. As an example of sulfurized fatty acid polyesters, there may be mentioned sulfurized pentaerythritol fatty acid esters.

An advantage of the invention is to provide a grease composition free from sulfurized olefins and/or polysulphides. In fact, sulfurized fatty acid esters have a reduced environmental impact, as these are compounds originating from renewable resources (fatty substances and fatty acids) and contain a significant proportion of renewable carbon. This is not the case of the sulfurized olefins which are obtained by sulphurizing olefins, products of hydrocarbon origin and of polysulphides which are also obtained by sulphurizing hydrocarbon source materials. It is noteworthy to observe that good extreme-pressure performance was achieved using sulfurized fatty acid esters rather than sulfurized olefins or polysulphides, which are known for having better extreme-pressure properties, this being possible in particular due to the additional presence of a dimercaptothiadiazole derivative in the grease composition.

By "active sulphur" is meant within the meaning of the present invention, the sulphur that a chemical compound is capable of giving up or releasing when this compound is placed under the conditions of standard ASTM D1662. Standard ASTM D1662 defines a level of active sulphur of a compound at a given temperature as a difference expressed as a weighted percentage of sulphur content before and after reacting a sample of this sulfurized compound with a given quantity of copper for a set time.

The quantity of active sulphur at 150° C. (ASTM D1662) in the grease composition is one of the parameters that are important for obtaining good performance, in particular under extreme pressure. This quantity of active sulphur at 150° C. (ASTM D1662) in the grease composition must not be too low, or it is not possible to achieve satisfactory extreme-pressure behaviour. It must not be too high, or problems will arise from corrosiveness of the grease in particular to copper; neither will too high a quantity of active sulphur at 150° C. (ASTM D1662) in the absence of the dimercaptothiadiazole derivative give good performance, in particular under extreme pressure.

Preferably, the quantity of active sulphur at 150° C. according to standard ASTM D1662 provided by the sulfurized fatty acid ester in the grease composition is greater than or equal to 0.18% by mass with respect to the total mass of grease composition, preferably greater than or equal to 0.19%, more preferentially greater than or equal to 0.20%, even more preferentially greater than or equal to 0.21%. Preferably, the quantity of active sulphur at 150° C. according to standard ASTM D1662 provided by the sulfurized fatty acid ester in the grease composition is less than or equal to 5% by mass with respect to the total mass of grease composition, preferably less than or equal to 4%, more preferentially less than or equal to 2%, even more preferentially less than or equal to 1%. Preferably, the quantity of sulphur according to standard ASTM D2662 by the sulfurized fatty acid ester in the grease composition is greater than or equal to 0.35% by mass with respect to the total mass of grease composition, preferably greater than or equal to 0.40%, more preferentially greater than or equal to 0.45%. Preferably, the grease composition comprises from 0.5 to 5% by mass with respect to the total mass of grease composition of sulfurized fatty acid ester, preferably from 1 to 4%, more preferentially from 2 to 3%.

Preferably, the grease composition according to the invention comprises at least two different sulfurized fatty acid esters, in order to improve the extreme-pressure performance, preferentially at least one sulfurized fatty acid methyl ester and at least one sulfurized fatty acid triglyceride. For a given quantity of active sulphur at 150° C., the combination of two different sulfurized fatty acid esters, in particular a sulfurized fatty acid methyl ester and a sulfurized fatty acid triglyceride, makes it possible to improve the extreme-pressure performance because the sulphur is not released in the same manner. The least hindered ester, such as the sulfurized fatty acid methyl ester, will be the quickest to release the active sulphur, then the most hindered ester, such as the sulfurized fatty acid triglyceride, will take its turn. The sulfurized fatty acid esters used in the present invention are products that are commercially available, for example from the suppliers PCAS, King Industries, Dover, Magna, Arkema, Rhein Chemie.

Dimercaptothiadiazole Derivative

The grease compositions according to the invention comprise at least one dimercaptiothiadiazole derivative, an essential element of the invention for obtaining good extreme-pressure performance. Thiadiazoles are heterocyclic compounds comprising two nitrogen atoms, one sulphur atom, two carbon atoms and two doubles bonds, having the general formula $C_2N_2SH_2$, capable of existing in the following forms, respectively: 1,2,3-thiadiazole; 1,2,4-thiadiazole; 1,2,5-thiadiazole; 1,3,4-thiadiazole:

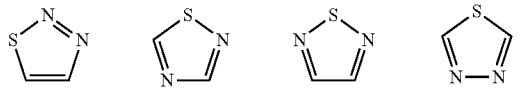

1,2,3-thiadiazole 1,2,4-thiadiazole 1,2,5-thiadiazole 1,3,4-thiadiazole

By dimercaptothiadiazole derivative according to the invention, is meant chemical compounds derived from the following four dimercaptothiadiazole molecules below: 4,5-dimercapto-1,2,3-thiadiazole, 3,5-dimercapto-1,2,4-thiadiazole, 3,4-dimercapto-1,2,5-thiadiazole, 2,5-dimercapto-1,3,4-thiadiazole, used alone or in a mixture:

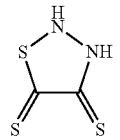

4,5-dimercapto-1,2,3-thiadiazole

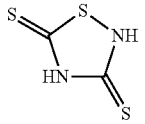

3,5-dimercapto-1,2,4-thiadiazole

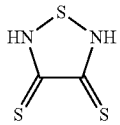

3,4-dimercapto-1,2,5-thiadiazole

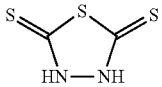

2,5-dimercapto-1,3,4-thiadiazole

In particular, by way of example, 2,5-dimercapto-1,3,4-thiadiazole, derivatives of 2,5-dimercapto-1,3,4-thiadiazole are molecules of general formula (I) or (II) used alone or in a mixture:

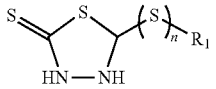

(I)

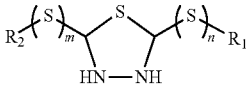

(II)

in which, $R_1$ and $R_2$ are independently of each other, hydrogen atoms, linear or branched, saturated or unsaturated alkyl groups, comprising from 1 to 24 carbon atoms, preferably from 2 to 18, more preferentially from 4 to 16, even more preferentially from 8 to 12 or aromatic substituents, n and m being independently of each other integers equal to 1, 2, 3 or 4.

The dimercaptothiadiazole derivatives are sulfurized compounds such as sulfurized fatty acid esters, but this sulphur is stabilized in the ring and will not be released like the sulphur present in the sulfurized fatty acid esters. Thus the dimercaptothiadiazole derivatives do not contain active sulphur at 150° C. unlike sulfurized fatty acid esters. The active sulphur at 150° C. is therefore provided only by the sulfurized fatty acid ester.

Preferably, the quantity of sulphur according to standard D2622 provided by the dimercaptothiadiazole derivative in the grease composition is comprised between 0.05 and 0.50% by mass with respect to the total mass of grease composition, preferably between 0.10 and 0.30%, more preferentially between 0.15 and 0.20%. Preferably, the grease compositions according to the invention comprise from 0.1 to 5% by mass of dimercaptothiadiazole derivative with respect to the total mass of the lubricant composition, preferably from 0.2 to 4%, more preferentially from 0.3 to 2%, even more preferentially from 0.5 to 1%. The dimercaptothiadiazole derivatives used in the present invention are products that are commercially available, for example from the suppliers Vanderbilt, Rhein Chemie, Afton.

Base Oil of the Polyol Ester Type

The grease composition according to the invention comprises at least one base oil of renewable origin based on a polyol ester. The polyol esters that can be used as base oil are diesters, triesters, tetraesters or complex esters comprising more than four ester functions.

The acids that can be used to form the esters are monocarboxylic acids or dicarboxylic acids. Preferably, the monocarboxylic acids have from 3 to 22 carbon atoms, more preferentially from 4 to 20, even more preferentially from 6 to 18, even more preferentially from 8 to 16, even more preferentially from 10 to 12.

There may be mentioned for example hexanoic acid, octanoic acid, 2-ethylhexanoic acid, isooctanoic acid, nonanoic acid, decanoic acid, isodecanoic acid, oleic acid, stearic acid. Preferably, saturated acids containing no unsaturations are used. Preferably, the dicarboxylic acids have from 3 to 22 carbon atoms, more preferentially from 4 to 20, even more preferentially from 6 to 18, even more preferentially from 8 to 16, even more preferentially from 10 to 12. There may be mentioned for example succinic acid, adipic acid, azelaic acid, sebacic acid.

The alcohols that can be used to form the esters are monoalcohols (formation of diesters with dicarboxylic acids), dialcohols, trialcohols or tetraalcohols. The preferred alcohols are polyols such as neopentylglycol, trimethylolpropane, pentaerythritol.

In order to obtain a sufficient biodegradability, the grease composition according to the invention comprises from 50 to 95% by mass with respect to the total mass of grease composition of polyol ester, preferably from 60 to 90%, more preferentially from 70 to 80%. These base oils of the ester type are chosen for their negligible environmental impact in contrast to the base oils originating from petroleum that are conventionally used. Nevertheless the utilization of such base oils of polyol ester type has a negative impact on the extreme-pressure properties, since these base oils of polyol ester type likewise have a tendency to migrate to the surface of the lubricated parts and are in competition with the other additives, hence the utilization of the specific combination of dimercaptothiadiazole and sulfurized fatty acid ester.

The base oil of the polyol ester type or the mixture of base oils of the polyol ester type has a kinematic viscosity at 40° C. comprised between 3 and 2000 cSt (measured according to standard ASTM D445), preferably between 10 and 1500 cSt, more preferentially between 20 and 1000 cSt, even more preferentially between 40 and 500 cSt, even more preferentially between 50 and 200 cSt. These viscosity ranges, in particular from 50 to 200 cSt, make it possible to achieve a good compromise between extreme-pressure performance and biodegradability. The base oils used in the present invention are products that are commercially available, for example from the suppliers Uniqema, Croda, Oleon, Akzo, Nyco.

Soaps

The grease compositions according to the invention are thickened with fatty-acid metal soaps, which can be prepared separately, or in situ during the manufacture of the grease (in the latter case, the fatty acid is dissolved in the base oil, then the appropriate metal hydroxide is added). These thickening agents are products commonly utilized in the field of greases, easily available and cost-effective. Greases thickened with fatty-acid metal soaps have a very good mechanical stability, in comparison, for example, with greases comprising thickening agents based on polyureas, which allows easy use in applications where the grease is applied in an unconfined space. Furthermore the polyureas are prepared from isocyanate, an extremely toxic compound, it is therefore not desirable to use thickening agents based on polyureas in order to obtain a grease that is biodegradable, non toxic and free from products classified under CLP Regulation (EC) No 1272/2008. The grease according to the invention is therefore free from thickening agents based on polyurea and therefore comprises only thickening agents of the fatty-acid metalsoaps type.

Preferentially, long-chain fatty acids are used, typically comprising from 10 to 28 carbon atoms, saturated or unsaturated, optionally hydroxylated. The long-chain fatty acids (typically comprising from 10 to 28 carbon atoms), are for example capric acid, lauric acid, myristic acid, palmitic acid, stearic acid, arachidic acid, behenic acid, oleic acid, linoleic acid, erucic acid and their hydroxylated derivatives. 12-hydroxystearic acid, the best-known derivative of this category, is preferred. Lithium 12-hydoxystearate is the preferred thickening agent. These long-chain fatty acids generally originate from vegetable oils, for example palm oil, castor oil, rapeseed oil, sunflower oil, etc. or animal fats (tallow, whale oil, etc).

Soaps known as simple soaps can be formed by using one or more long-chain fatty acids. Simple soaps are preferred to the complex soaps, because they are more easily biodegradable and do not bioaccumulate. Soaps known as complex soaps can also be formed by using one or more long-chain fatty acids in combination with one or more carboxylic acids with short hydrocarbon chains comprising at most 8 carbon atoms.

The saponification agent used to produce the soap can be a metallic compound of lithium, sodium, calcium, aluminium; preferentially lithium and calcium, and preferably a hydroxide, oxide or a carbonate of these metals. One or more metallic compounds, whether or not having the same metallic cation, can be used in the greases according to the invention. It is thus possible to use lithium soaps in combination with calcium soaps in a smaller proportion. The metal soaps are utilized at contents of the order of 1 to 20% by mass with respect to the total mass of the grease composition, preferably from 2 to 15%, preferentially from 4 to 10%.

Process for Preparation of the Greases

The greases according to the invention are produced by forming the metal soap in situ or by using a preformed soap. The process for the preparation of the grease by forming the metal soap in situ is the following.

One or more long-chain or short-chain fatty acids are dissolved in a fraction of the base oil or of the mixture of base oil at a temperature comprised between 80° C. and 90° C. This fraction is generally of the order of 40% to 60% by mass of the total quantity of oil contained in the final grease.

Then metallic compounds are added at the same temperature, preferentially of the metallic oxide, hydroxide or carbonate type. It is thus possible to add a single type of metal or to combine several metals. The preferred metal of the compositions according to the invention is lithium, optionally combined, in a smaller proportion, with calcium.

The saponification reaction of the long-chain or short-chain fatty acids with the metallic compound(s) is left to develop at a temperature between 80° C. and 90° C. The water formed is then evaporated off by heating the mixture at a temperature of approximately 100° C. to 200° C. The grease is then cooled down by the remaining fraction of base oil. Then, at approximately 80° C., the dimercaptothiadazole derivative and the sulfurized fatty acid ester and any other additives are incorporated. Stirring is then carried out for a sufficient time in order to obtain a grease composition, which is then ground in order to improve its uniformity.

The process for the preparation of the grease with the preformed metal soap is identical save that there is no saponification reaction, since the soap is already formed. These preparation processes are well known to a person skilled in the art.

Consistency of the Greases

The consistency of a grease measures its hardness or its fluidity at rest. It is assigned a numerical value by the depth of penetration of a cone of given dimensions and weight. The grease undergoes prior stirring. The conditions for the measurement of the consistency of a grease are defined by standard ASTM D 217.

According to their consistency, greases are divided into 9 classes or 9 NLGI (National Lubricating Grease Institute) grades commonly used in the field of greases. These grades are indicated in the table below.

| NLGI grade | Consistency according to ASTM D 217 (tenths of a millimeter) |
|---|---|
| 000 | 445-475 |
| 00 | 400-430 |
| 0 | 355-385 |
| 1 | 310-340 |
| 2 | 265-295 |
| 3 | 220-250 |
| 4 | 175-205 |
| 5 | 130-160 |
| 6 | 85-115 |

Preferably, the greases according to the invention have a consistency comprised between 220 and 430 tenths of a millimeter according to standard ASTM D217, covering grades 00, 0, 1, 2 and 3. Preferably, the greases according to the invention have a consistency comprised between 265 and 295 tenths of a millimeter according to standard ASTM D217, to cover grade 2.

Other Additives

The grease compositions according to the invention can also contain antioxidant additives, for example antioxidants of the phenolic type, anti-rust additives, such as for example oxidized waxes or amine phosphates, corrosion inhibitor additives such as tolyltriazoles.

Technical Performance of the Greases

The grease compositions according to the invention have good extreme-pressure performance. In particular, the grease compositions according to the invention have a welding load measured according to standard ASTM D2596 greater than 315 kg, preferably greater than or equal to 400 kg. In particular, the grease compositions according to the invention have a welding load measured according to standard DIN 51350/4 greater than 300 daN, preferably greater than or equal to 320 daN, more preferentially greater than or equal to 340 daN. The grease compositions according to the invention are also only slightly corrosive, in particular to metals or metal alloys, and more particularly to copper. In particular, the grease compositions according to the invention tarnish copper strips only slightly (classification 1 according to standard ASTM D4048) or tarnish copper strips only moderately (classification 2 according to standard ASTM D4048).

In addition to having good extreme-pressure properties and not being corrosive to metals and metal alloys and more particularly to copper, the grease compositions according to the invention have a reduced environmental impact. In particular, the greases according to the invention are biodegradable, do not bioaccumulate, are non toxic for aquatic mediums and are renewable.

Preferably, the grease compositions according to the invention contain additives which are not hazardous to the environment and human health. Preferably, the grease compositions according to the invention are free from organic halogenated compounds, nitrite type compounds, metals or metallic compounds other than sodium, potassium, magnesium, calcium, lithium and/or aluminium. Preferably, the grease compositions according to the invention are not toxic to the aquatic environment. In particular the grease compositions according to the invention have an aquatic toxicity to algae, daphnia and fish of at least 1000 mg/l according to standards OECD 201, 202 and 203.

Similarly, the main constituents of the grease, i.e. those present at more than 5% by mass with respect to the total mass of the grease composition, such as the base oil and the soap, have an aquatic toxicity to algae and daphnia of at least 100 mg/l according to standards OECD 201 and 202.

Similarly, when a constituent has an aquatic toxicity to algae and daphnia of at least 100 mg/l according to standards OECD 201 and 202 (category D), said constituent can be present in the grease at any concentration. The grease compositions according to the invention have a concentration by mass of constituents having an aquatic toxicity to algae and daphnia comprised between 10 mg/l and 100 mg/l according to standards OECD 201 and 202 (category E), less than or equal to 25%. The grease compositions according to the invention have a concentration by mass of constituents having an aquatic toxicity to algae and daphnia comprised between 1 mg/l and 10 mg/l according to standards OECD 201 and 202 (category F), less than or equal to 2%, preferably less than or equal to 1%. This only concerns the constituents of the grease the concentration by mass in the grease of which is greater than or equal to 0.1%.

The grease compositions according to the invention are biodegradable and do not bioaccumulate. In particular, the grease compositions according to the invention have a concentration by mass of constituents that are ultimately biodegradable in an aerobic medium (category A according to standards OECD 301A-F, OECD 306, OECD 301) greater than 75%, a concentration by mass of constituents that are intrinsically biodegradable in an aerobic medium (category B according to standards OECD 302B, OECD 302C) or of non-biodegradable constituents and those that do not bioaccumulate (category C) less than or equal to 25%, and a concentration by mass of non-biodegradable constituents and those that bioaccumulate (category X) less than or equal to 0.1%. This only concerns the constituents of the grease the concentration by mass in the grease of which is greater than or equal to 0.1%.

The grease compositions according to the invention contain at least 45% by mass with respect to the total mass of grease composition of carbon originating from renewable raw materials. The invention also relates to a lubrication process using the above-described grease compositions, said process consisting of contacting the parts to be lubricated with the above-described grease compositions.

Finally, the invention relates to a lubricant composition comprising at least one base oil of the polyol ester type, at least one dimercaptothiadiazole and at least one sulfurized fatty acid ester, the quantity of active sulphur at 150° C. according to standard ASTM D1662 by mass provided by the sulfurized fatty acid ester with respect to the total mass of grease composition being greater than or equal to 0.17%. The polyol ester type base oil has all the above-mentioned features. The same goes for the dimercaptothiadiazole derivative and the fatty acid ester. The quantities used are those described in the present application and are expressed with respect to the total mass of lubricant composition rather than of grease composition. The lubricant compositions therefore comprise the same additives as the grease compositions except for the soap. The viscosity of the lubricant compositions is that of the base oils. The lubricant compositions also have good extreme-pressure and anti-corrosion properties, while having a reduced environmental impact.

EXAMPLES

Different grease compositions are prepared from:

lithium 12-hydroxystearate (thickening agent). Its aquatic toxicity to algae and daphnia is over 100 mg/l according to standards OECD 201 and 202 (category D). Its biodegradability is equal to 83.8% according to standard OECD 301B (category A).

a dimercaptothiadiazole derivative which is a mixture of the products of general formulae (I) and (II), with $R_1$ and $R_2$ being linear alkyl groups comprising an average number of 12 carbons, n being equal to 1. Its aquatic toxicity to algae and daphnia is category E according to the standards OECD 201 and 202, its biodegradability is category C according to standard OECD 301B.

sulfurized fatty acid methyl ester (sulfurized ester 1), comprising 17% by mass of sulphur with respect to the total mass of sulfurized ester and 48% by mass of active sulphur at 150° C. with respect to the total mass of sulfurized ester. Its aquatic toxicity to algae and daphnia is comprised between 10 mg/l and 100 mg/l according to standards OECD 201 and 202 (category E). Its biodegradability is category C according to standard OECD 301B. It comprises 95% by mass of renewable carbon with respect to the total mass of sulfurized ester.

sulfurized fatty acid triglycerides (sulfurized ester 2), comprising 15% by mass of sulphur with respect to the total mass of sulfurized ester and 33% by mass of active sulphur at 150° C. with respect to the total mass of sulfurized ester. 60% by mass of the sulfurized ester with respect to the total mass of sulfurized ester has an aquatic toxicity to algae and daphnia comprised between 10 mg/l and 100 mg/l according to standards OECD 201 and 202 (category E) and 40% by mass of the sulfurized ester has an aquatic toxicity to algae and daphnia comprised between 1 mg/l and 10 mg/l according to standards OECD 201 and 202 (category E). Its biodegradability is category C according to standard OECD 301B. It comprises 95% by mass of renewable carbon with respect to the total mass of sulfurized ester.

ester of trimethylolpropane and saturated fatty acids (base oil 1). Its kinematic viscosity at 100° C. (ASTM D445) is 4.4 cSt, its kinematic viscosity at 40° C. (ASTM D445) is 19.6 cSt. Its aquatic toxicity to algae and daphnia is over 100 mg/l according to standards OECD 201 and 202 (category D). Its biodegradability is equal to 79% according to standard OECD 301B (category A). It comprises 81% by mass of renewable carbon with respect to the total mass of sulfurized ester.

ester of trimethylolpropane and saturated fatty acids (base oil 2). Its kinematic viscosity at 100° C. (ASTM D445) is 32.2 cSt and its kinematic viscosity at 40° C. (ASTM D445) is 316 cSt. Its aquatic toxicity to algae and daphnia is over 100 mg/l according to standards OECD 201 and 202 (category D). Its biodegradability is equal to 67% according to standard OECD 301B (category A). It comprises 55% by mass of renewable carbon with respect to the total mass of sulfurized ester.

4,4'-methylene bis 2,6-di-tertio-butylphenol (antioxidant 1),

Octadecyl 3-(3,5-ditertiobutyl-4-hydroxyphenyl) propanoate (antioxidant 2). Its aquatic toxicity to algae and daphnia is over 100 mg/1 according to standards OECD 201 and 202 (category D). Its biodegradability is category B according to standard OECD 301B.

Oxidized hydrocarbon waxes (corrosion inhibitor 1). Their aquatic toxicity to algae and daphnia is comprised between 10 mg/l and 100 mg/l according to standards OECD 201 and 202 (category E). Its biodegradability is equal to 55% according to standard OECD 301B (category B).

Tolyltriazole (corrosion inhibitor 2). Its aquatic toxicity to algae and daphnia is comprised between 1 mg/1 and 10 mg/l according to standards OECD 201 and 202 (category F). Its biodegradability is equal to 4% according to standard OECD 301B (category C).

in the proportions (% by mass) of the following Table I:

TABLE 1

| Composition by mass of the greases | | | | | | | | |
|---|---|---|---|---|---|---|---|---|
| | $GT_1$ | $GT_2$ | $GT_3$ | $GT_4$ | $GI_5$ | $GI_6$ | $GT_7$ | $GT_8$ |
| Base oil 1 | 19.63 | 19.40 | 19.38 | 19.49 | 19.15 | 19.15 | 19.25 | 19.06 |
| Base oil 2 | 65.72 | 64.95 | 64.97 | 65.26 | 64.20 | 64.20 | 64.60 | 63.79 |
| Thickening agent | 10.96 | 10.96 | 10.96 | 10.96 | 10.96 | 10.96 | 10.96 | 10.96 |
| Antioxidant 1 | 0.09 | 0.09 | 0.09 | 0.09 | 0.09 | 0.09 | 0.09 | 0.09 |
| Antioxidant 2 | 1.00 | 1.00 | 1.00 | 1.00 | 1.00 | 1.00 | 1.00 | 1.00 |
| Corrosion inhibitor 1 | 1.00 | 1.00 | 1.00 | 1.00 | 1.00 | 1.00 | 1.00 | 1.00 |
| Corrosion inhibitor 2 | 0.10 | 0.10 | 0.10 | 0.10 | 0.10 | 0.10 | 0.10 | 0.10 |
| Dimercapto-thiadiazole derivative | 0.50 | 0.50 | 0.50 | 0.50 | 0.50 | 0.50 | — | — |
| Sulfurized ester 1 | 1.00 | — | 1.00 | 2.00 | 1.00 | 2.00 | 1.00 | — |
| Sulfurized ester 2 | — | 2.00 | 1.00 | — | 2.00 | 1.00 | 2.00 | 4.00 |

The control greases and greases according to the invention have the following biochemical characteristics (Table II):

TABLE II

| Biochemical characteristics of the greases | | | | | | | | |
|---|---|---|---|---|---|---|---|---|
| | $GT_1$ | $GT_2$ | $GT_3$ | $GT_4$ | $GI_5$ | $GI_6$ | $GT_7$ | $GT_8$ |
| Quantity of sulphur fatty acid ester | 0.17 | 0.30 | 0.32 | 0.34 | 0.47 | 0.49 | 0.47 | 0.60 |
| Quantity of sulphur dimercaptothiadiazole | 0.15 | 0.15 | 0.15 | 0.15 | 0.15 | 0.15 | 0.00 | 0.00 |
| Quantity of active sulphur at 150° C. fatty acid ester | 0.082 | 0.010 | 0.131 | 0.163 | 0.181 | 0.213 | 0.181 | 0.199 |
| Aquatic toxicity Category E (%) | 2.5 | 2.7 | 3.1 | 3.5 | 3.7 | 4.1 | 3.2 | 3.4 |
| Aquatic toxicity Category F (%) | 0.1 | 0.9 | 0.5 | 0.2 | 0.9 | 0.5 | 0.9 | 1.7 |
| Biodegradability Category A (%) | 96 | 95 | 95 | 96 | 94 | 94 | 95 | 94 |
| Biodegradability Category B + C (%) | 3.6 | 4.6 | 4.6 | 4.6 | 5.6 | 5.6 | 5.1 | 6.1 |
| Renewable carbon (%) | 53 | 53 | 53 | 54 | 54 | 54 | 54 | 54 |

These grease compositions were subjected to extreme-pressure and corrosiveness tests (Table III). The control greases and greases according to the invention have the following performances (Table III):

TABLE III

| Extreme-pressure and corrosion performance of the greases | | | | | | | | |
|---|---|---|---|---|---|---|---|---|
| | $GT_1$ | $GT_2$ | $GT_3$ | $GT_4$ | $GI_5$ | $GI_6$ | $GT_7$ | $GT_8$ |
| 4-ball extreme pressure Welding load (kg) (1) | 315 | 315 | 315 | 315 | 400 | 400 | 315 | 315 |
| 4-ball extreme pressure Last load before welding (daN) (2) | 260 | 260 | 280 | 280 | 300 | 320 | 260 | 280 |
| 4-ball extreme pressure Welding load (daN) (2) | 280 | 280 | 300 | 300 | 320 | 340 | 280 | 300 |
| Copper corrosion (3) | 1b | 1b | 1b | 1b | 1b | 1b | 1b | 1b |

(1) ASTM D2596
(2) DIN 51350/4
(3) ASTM D4048

The grease compositions $GT_1$ to $GT_4$ are control greases comprising both a dimercaptothadiazole derivative and a sulfurized fatty acid ester but with low active sulphur contents at 150° C. The grease compositions $GT_1$ to $GT_4$ have a low welding load of 315 kg (ASTM D2596) or 280 or even 300 daN (DIN 51350/4).

The grease compositions $GI_5$ and $GI_6$ are greases according to the invention comprising both a dimercaptothadiazole derivative and a sulfurized fatty acid ester but with higher active sulphur contents at 150° C. The grease compositions $GI_5$ and $GI_6$ have an improved welding load of 400 kg (ASTM D2596) or 320 or even 340 daN (DIN 51350/4).

The grease compositions $GT_7$ and $GT_8$ are control greases not comprising any dimercaptothadiazole derivative, comprising only a sulfurized fatty acid ester with high active sulphur contents at 150° C. The grease compositions $GT_5$ and $GT_6$ have a low welding load of 315 kg (ASTM D2596) or 280 or even 300 daN (DIN 51350/4). The presence of the sulfurized fatty acid ester alone is not sufficient to obtain good extreme-pressure performance.

These grease compositions are in addition only slightly corrosive to copper. These results demonstrate that obtaining high extreme-pressure performance is due to the presence of the dimercaptothiadiazole derivative in combination with a sulfurized fatty acid ester which provides to the grease composition a quantity of active sulphur at 150° C. greater than or equal to 0.18% by mass with respect to the total mass of grease composition. This extreme-pressure performance goes hand in hand with a low corrosiveness of the grease and a grease which is biodegradable, does not bioaccumulate, is non-toxic, and originates from renewable raw materials.

The invention claimed is:

1. A grease composition comprising, based on the total mass of the grease composition:

from 70 to 90% by mass of at least one base oil of a polyol ester type comprising polyol esters, the polyol esters being trimethylolpropane esters having a kinematic viscosity at 40° C., measured according to standard ASTM D 455, of between 10 and 1500 cSt, from 4 to 15% by mass of at least one fatty-acid lithium soap, from 0.5 to 1% by mass of a derivative of 2,5-dimercapto-1,3,4-thiadiazole which is a mixture of compounds of general formula (I) and (II), formula (I) and formula (II) being:

(I)

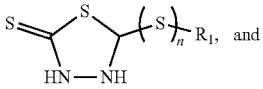

and

-continued (II)

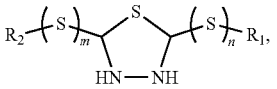

wherein $R_1$ and $R_2$ are, independently of each other, hydrogen atoms, linear or branched, saturated or unsaturated alkyl groups comprising from 1 to 24 carbon atoms, and n and m being independently of each other integers equal to 1, 2, 3 or 4, from 2 to 4% by mass of a sulfurized fatty acid ester selected from a sulfurized fatty acid methyl ester and a sulfurized fatty acid triglyceride, used alone or in a mixture, and a quantity by mass of active sulphur at 150° C. according to standard ASTM D1662 provided by the sulfurized fatty acid ester with respect to a total mass of grease composition being greater than or equal to 0.18% and less than or equal to 0.213%, wherein the grease composition has a welding load measured according to standard ASTM D2596 of greater than 315 kg and has a classification of corrosiveness according to standard ASTM D4048 of 1 or 2.

2. The composition according to claim 1, in which the fatty-acid lithium soap is a simple fatty-acid lithium soap.

3. The composition according to claim 1, in which the fatty-acid lithium soap is lithium 12-hydroxystearate.

4. The composition according to claim 1, having a consistency according to standard ASTM D217 comprised between 220 and 430 tenths of a millimeter.

5. The composition according to claim 1, having a welding load according to standard DIN 51350/4 greater than 300 daN.

6. A method of lubricating a device, the method comprising contacting parts of the device to be lubricated with a grease composition comprising, based on the total weight of the grease composition:

from 70 to 90% by mass of at least one base oil of a polyol ester type comprising polyol esters, the polyol esters being trimethylolpropane esters having a kinematic viscosity at 40° C., measured according to standard ASTM D 455, of between 10 and 1500 cSt, from 4 to 15% by mass of at least one fatty-acid lithium soap, from 0.5 to 1% by mass of a derivative of 2,5-dimercapto-1,3,4-thiadiazole which is a mixture of compounds of general formula (I) and (II), formula (I) and formula (II) being:

(I)

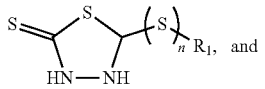

and (II)

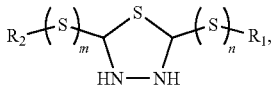

wherein $R_1$ and $R_2$ are, independently of each other, hydrogen atoms, linear or branched, saturated or unsaturated alkyl groups comprising from 1 to 24 carbon atoms, and n and m being independently of each other integers equal to 1, 2, 3 or 4, from 2 to 4% of a sulfurized fatty acid ester selected from a sulfurized fatty acid methyl ester and a sulfurized fatty acid triglyceride, used alone or in a mixture, and a quantity by mass of active sulphur at 150° C. according to standard ASTM D1662 provided by the sulfurized fatty acid ester being greater than or equal to 0.18% with respect to a total mass of grease composition and less than or equal to 0.213%, wherein the grease composition has a welding load measured according to standard ASTM D2596 of greater than 315 kg and has a classification of corrosiveness according to standard ASTM D4048 of 1 or 2.

7. A lubricant composition comprising, based on the total weight of the lubricant composition:

from 70 to 90% by mass of at least one base oil of a polyol ester type comprising polyol esters, the polyol esters being trimethylolpropane esters having a kinematic viscosity at 40° C., measured according to standard ASTM D 455, of between 10 and 1500 cSt, from 0.5 to 1% by mass of a derivative of 2,5-dimercapto-1,3,4-thiadiazole which is a mixture of compounds of general formula (I) and (II), formula (I) and formula (II) being:

(I)

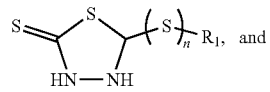

and (II)

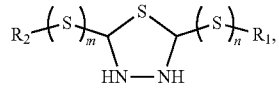

wherein $R_1$ and $R_2$ are, independently of each other, hydrogen atoms, linear or branched, saturated or unsaturated alkyl groups comprising from 1 to 24 carbon atoms, and n and m being independently of each other integers equal to 1, 2, 3 or 4, from 2 to 4% of a sulfurized fatty acid ester selected from a sulfurized fatty acid methyl ester and a sulfurized fatty acid triglyceride, used alone or in a mixture, and a quantity by mass of active sulphur at 150° C. according to standard ASTM D1662 provided by the sulfurized fatty acid ester with respect to a total mass of lubricant composition being greater than or equal to 0.18% and less than or equal to 0.213%, wherein the grease composition has a welding load measured according to standard ASTM D2596 of greater than 315 kg and has a classification of corrosiveness according to standard ASTM D4048 of 1 or 2.

8. The composition according to claim 1, comprising 1% by mass of the derivative of 2,5-dimercapto-1,3,4-thiadiazole and 3% of the sulfurized fatty acid ester.

* * * * *